US006933483B2

(12) United States Patent
Chun

(10) Patent No.: US 6,933,483 B2
(45) Date of Patent: Aug. 23, 2005

(54) MICROWAVE OVEN AND METHOD OF CONTROLLING THE SAME

(75) Inventor: Yun-Bong Chun, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 68 days.

(21) Appl. No.: 10/356,638

(22) Filed: Feb. 3, 2003

(65) Prior Publication Data

US 2004/0040956 A1 Mar. 4, 2004

(30) Foreign Application Priority Data

Aug. 29, 2002 (KR) ..... 2002-51628

(51) Int. Cl.[7] ..... H05B 6/68
(52) U.S. Cl. ..... 219/720; 219/506; 219/702
(58) Field of Search ..... 219/702, 714, 219/720, 506; 700/211

(56) References Cited

U.S. PATENT DOCUMENTS 6,097,016 A * 8/2000 Hirata et al. ..... 219/720
6,180,934 B1 * 1/2001 Ishizaki et al. ..... 219/720
6,444,965 B1 * 9/2002 Ha et al. ..... 219/702
6,486,453 B1 * 11/2002 Bales et al. ..... 219/702
6,528,774 B2 * 3/2003 Lee ..... 219/702
6,549,818 B1 * 4/2003 Ali ..... 219/720
6,744,026 B2 * 6/2004 Ishikawa ..... 219/702
2002/0121514 A1 9/2002 Ishikawa
2003/0000947 A1 * 1/2003 Kim ..... 219/702
2003/0121912 A1 * 7/2003 Kyung-Hwan et al. ..... 219/702

* cited by examiner

*Primary Examiner*—Teresa J. Walberg
(74) *Attorney, Agent, or Firm*—Staas & Halsey LLP

(57) ABSTRACT

A microwave oven readily registers cooking courses in a favorites menu or deletes the cooking courses from the favorites menu in one registering or deleting operation, thereby simplifying an operation of registering or deleting the cooking courses of the favorites menu. That is, the microwave oven registers or deletes the cooking courses corresponding to the favorites menu at one time. The microwave oven has a plurality of favorites menus, and classifies and registers the cooking courses so as to allow a user to effectively use the cooking courses.

16 Claims, 10 Drawing Sheets

R:REGISTRATION

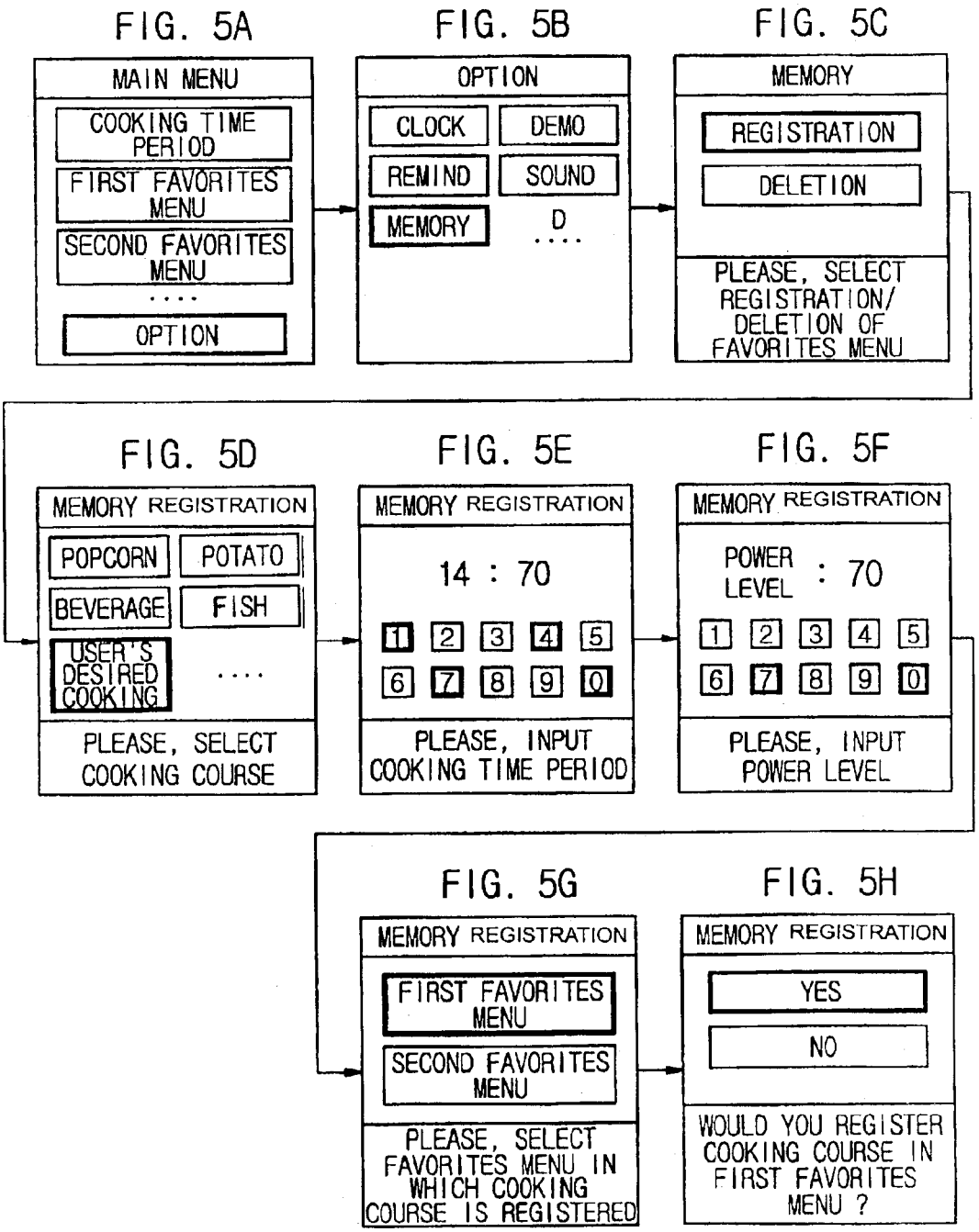
FIG. 5A
MAIN MENU
COOKING TIME PERIOD
FIRST FAVORITES MENU
SECOND FAVORITES MENU
....
OPTION
FIG. 5B
OPTION
CLOCK
DEMO
REMIND
SOUND
MEMORY
D
....
FIG. 5C
MEMORY
REGISTRATION
DELETION
PLEASE, SELECT REGISTRATION/ DELETION OF FAVORITES MENU
FIG. 5D
MEMORY REGISTRATION
POPCORN
POTATO
BEVERAGE
FISH
USER'S DESIRED COOKING
....
PLEASE, SELECT COOKING COURSE
FIG. 5E
MEMORY REGISTRATION
14 : 70
1 2 3 4 5
6 7 8 9 0
PLEASE, INPUT COOKING TIME PERIOD
FIG. 5F
MEMORY REGISTRATION
POWER LEVEL : 70
1 2 3 4 5
6 7 8 9 0
PLEASE, INPUT POWER LEVEL
FIG. 5G
MEMORY REGISTRATION
FIRST FAVORITES MENU
SECOND FAVORITES MENU
PLEASE, SELECT FAVORITES MENU IN WHICH COOKING COURSE IS REGISTERED
FIG. 5H
MEMORY REGISTRATION
YES
NO
WOULD YOU REGISTER COOKING COURSE IN FIRST FAVORITES MENU ?

MAIN MENU
COOKING TIME PERIOD
FIRST FAVORITES MENU
SECOND FAVORITES MENU
....
OPTION

MEMORY REGISTRATION
POPCORN
POTATO
BEVERAGE
FISH
USER'S DESIRED COOKING
....
PLEASE, SELECT COOKING COURSE

POPCORN
12 : 34
COOKING

MEMORY REGISTRATION
POPCORN
POTATO
BEVERAGE
FISH
USER'S DESIRED COOKING
....
PLEASE, SELECT COOKING COURSE

USER'S DESIRED COOKING
12 : 34
POWER LEVEL:70
COOKING

MICROWAVE OVEN AND METHOD OF CONTROLLING THE SAME

CROSS-REFERENCE TO RELATED APPLICATIONS

This application claims the benefit of Korean Patent Application No. 2002-51628, filed Aug. 29, 2002, in the Korean Intellectual Property Office, the disclosure of which is incorporated herein by reference.

BACKGROUND OF THE INVENTION

1. Field of the Invention

The present invention relates to a microwave oven, and more particularly, to a microwave oven and a method of controlling the same, wherein the microwave oven includes a device which registers one or more cooking courses desired by a user.

2. Description of the Related Art

Generally, a microwave oven is an apparatus which cooks food by oscillating a microwave. Such a microwave oven includes a super-high frequency oscillation tube as a magnetron to generate a super-high frequency of, for example, 2,450 MHz in response to high-voltage power applied thereto. The super-high frequency of 2,450 MHz generated from the magnetron causes an electric field to turn in a direction at a rate of 2.45 billion times per second. This super-high frequency is applied to the food, thereby cooking the food through inducing a large amount of heat.

The microwave oven may be pre-stored with cooking information to automatically and appropriately cook food where one of various cooking courses corresponding to the pre-stored cooking information is selected. A user of the microwave oven can cook the food by selecting a desired cooking course.

The number of cooking courses has steadily increased with the development of various cooking methods. A conventional microwave oven registers cooking courses corresponding to a favorites menu button, according to a user's taste, so as so to readily search for a desired cooking course among a large number of cooking courses pre-stored in the microwave oven, and cook food according to the desired cooking course.

That is, to cook the food, the user presses the favorites menu button to select one of the registered cooking courses. Accordingly, a method of automatically cooking the food corresponding to the selected cooking course is thereby carried out.

FIGS. 1A to 1J illustrate a cooking course registration method disclosed in Korean Patent Publication No. 2002-32579. A microwave oven employed in the cooking course registration method is equipped with an operational panel which operates the microwave oven. A button for a favorites menu is provided in the operational panel. The microwave oven has pre-stored information related to cooking courses, such as heating, milk boiling, alcoholic drink boiling, flesh defrosting, etc., as illustrated in FIGS. 1A to 1D.

Where the microwave oven registers a new cooking course, a user of the microwave oven presses a button necessary to register the new cooking course. That is, the user searches for a desired cooking course through an indexing function related to the pre-stored cooking courses, and registers the searched cooking course in the microwave oven as shown in FIGS. 1E to 1J.

Accordingly, to register the new cooking course according to the conventional cooking course registration method disclosed in Korean Patent Publication No. 2002-32579, the user necessarily presses corresponding buttons and then registers the new cooking course after screens of FIGS. 1A to 1J are sequentially displayed. Where the user registers a cooking course such as an egg poaching in the microwave oven, the user selects the cooking course of the egg poaching displayed on a screen of FIG. 1H. After the cooking course of the egg poaching is selected, screens of FIGS. 1I and 1J are sequentially displayed.

However, to register another cooking course after registering the cooking course of the egg poaching, operations corresponding to the screens of FIGS. 1A to 1J are again necessarily repeated, and the screens re-displayed. Therefore, the conventional cooking course registration method disclosed above is inconvenient and time consuming to use.

On the other hand, to delete the registered cooking course (e.g., the egg poaching) according to a cooking course deletion method disclosed in Korean Patent Publication No. 2002-32579, the user necessarily and sequentially navigates through the screens of FIGS. 1A, 1B, 1C, 1D and 1E prior to designating a corresponding cooking course to be deleted from the registered cooking courses, and then finally presses a cancel button. Accordingly, the cooking course deletion method disclosed in Korean Patent Publication No. 2002-32579 is also inconvenient to use and time consuming.

SUMMARY OF THE INVENTION

Accordingly, an aspect of the present invention is to provide a microwave oven and a method of controlling the same, which simplifies an operation of registering or deleting cooking courses desired by a user.

Additional aspects and advantages of the invention will be set forth in part in the description which follows and, in part, will be obvious from the description, or may be learned by practice of the invention.

To achieve the above and/or other aspects of the present invention, there is provided a microwave oven which controls an operation of registering cooking courses in a favorites menu of the microwave oven, comprising a storage unit which stores the favorites menu and the cooking courses, an input unit which receives the cooking courses to be registered in the favorites menu, and a controller which controls the storage unit so as to allow the cooking courses corresponding to the favorites menu input through the input unit to be registered and stored in the storage unit.

To achieve the above and/or other aspects of the present invention, there is provided a microwave oven which controls an operation of deleting cooking courses registered in a favorites menu of the microwave oven, comprising a storage unit which stores a number of cooking courses corresponding to the favorites menu, an input unit which receives the cooking courses to be deleted among the number of cooking courses registered in the favorites menu, and a controller which controls the storage unit so as to allow the cooking courses selected through the input unit to be deleted from the favorites menu of the storage unit.

To achieve the above and/or other aspects of the present invention, there is provided a method of controlling a microwave oven to register cooking courses in a favorites menu of the microwave oven, the method comprising displaying a screen to receive the cooking courses to be registered, receiving the cooking courses selected from the displayed screen, and controlling an operation of registering the selected cooking courses in the favorites menu.

To achieve the above and/or other aspects of the present invention, there is provided a method of controlling a microwave oven to delete cooking courses among a number of cooking courses registered in a favorites menu of the microwave oven, the method comprising displaying a screen to receive the cooking courses to be deleted from the favorites menu, receiving the cooking courses selected from the displayed screen, and controlling an operation of deleting the selected cooking courses from the favorites menu.

To achieve the above and/or other aspects of the present invention, there is provided a method of controlling a microwave oven to delete cooking courses among a number of cooking courses registered in one of favorites menus of the microwave oven, the method comprising displaying a first screen to receive a favorites menu among the favorites menus, from which the cooking courses are to be deleted, receiving the favorites menu selected from the displayed first screen, displaying a second screen containing the cooking courses to be deleted among the number of cooking courses registered in the selected favorites menu, receiving the selected cooking courses to be deleted from the displayed second screen, and controlling an operation of deleting the selected cooking courses from the selected favorites menu.

BRIEF DESCRIPTION OF THE DRAWINGS

These and other aspects and advantages of the present invention will become apparent and more readily appreciated from the following description of the embodiments, taken in conjunction with the accompanying drawings of which:

FIGS. 5A to 5H are views illustrating a sequence of screens to register a user's desired cooking course in a favorites menu in accordance with another embodiment of the present invention;

DETAILED DESCRIPTION OF THE PREFERRED EMBODIMENTS

Figure 1A:
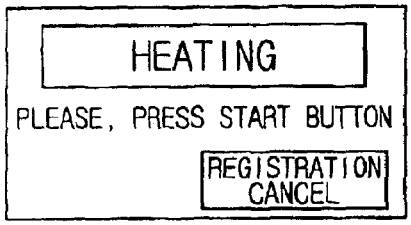
FIG. 1A (PRIOR ART)
FIGS. 1A to 1J are views illustrating a conventional method of registering a cooking course in a microwave oven.
Figure 1B:
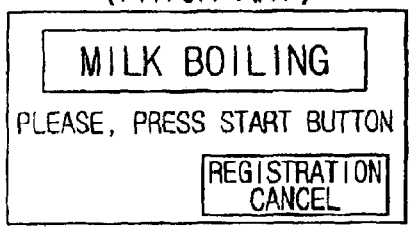
FIG. 1B (PRIOR ART)
Figure 1C:
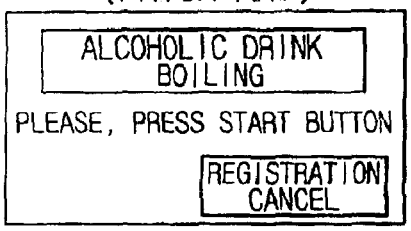
FIG. 1C (PRIOR ART)
Figure 1D:
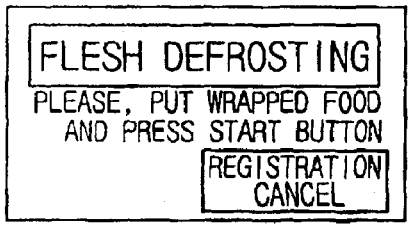
FIG. 1D (PRIOR ART)
Figure 1E:
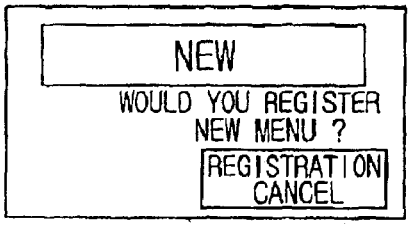
FIG. 1E (PRIOR ART)
Figure 1F:
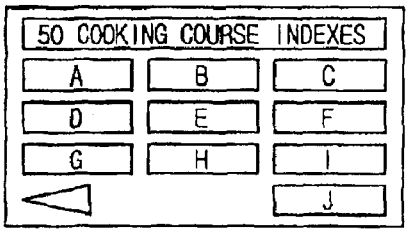
FIG. 1F (PRIOR ART)
Figure 1G:
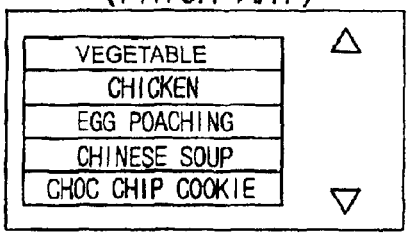
FIG. 1G (PRIOR ART)
Figure 1H:
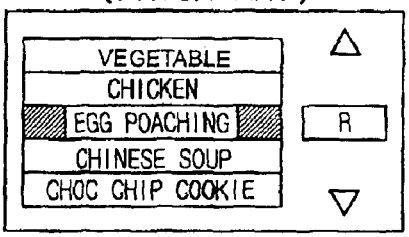
FIG. 1H (PRIOR ART)
Figure 1I:
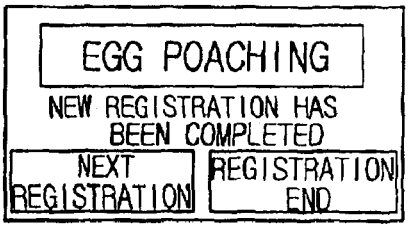
FIG. 1I (PRIOR ART)
Figure 1J:
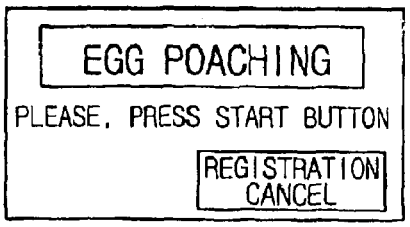
FIG. 1J (PRIOR ART)

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
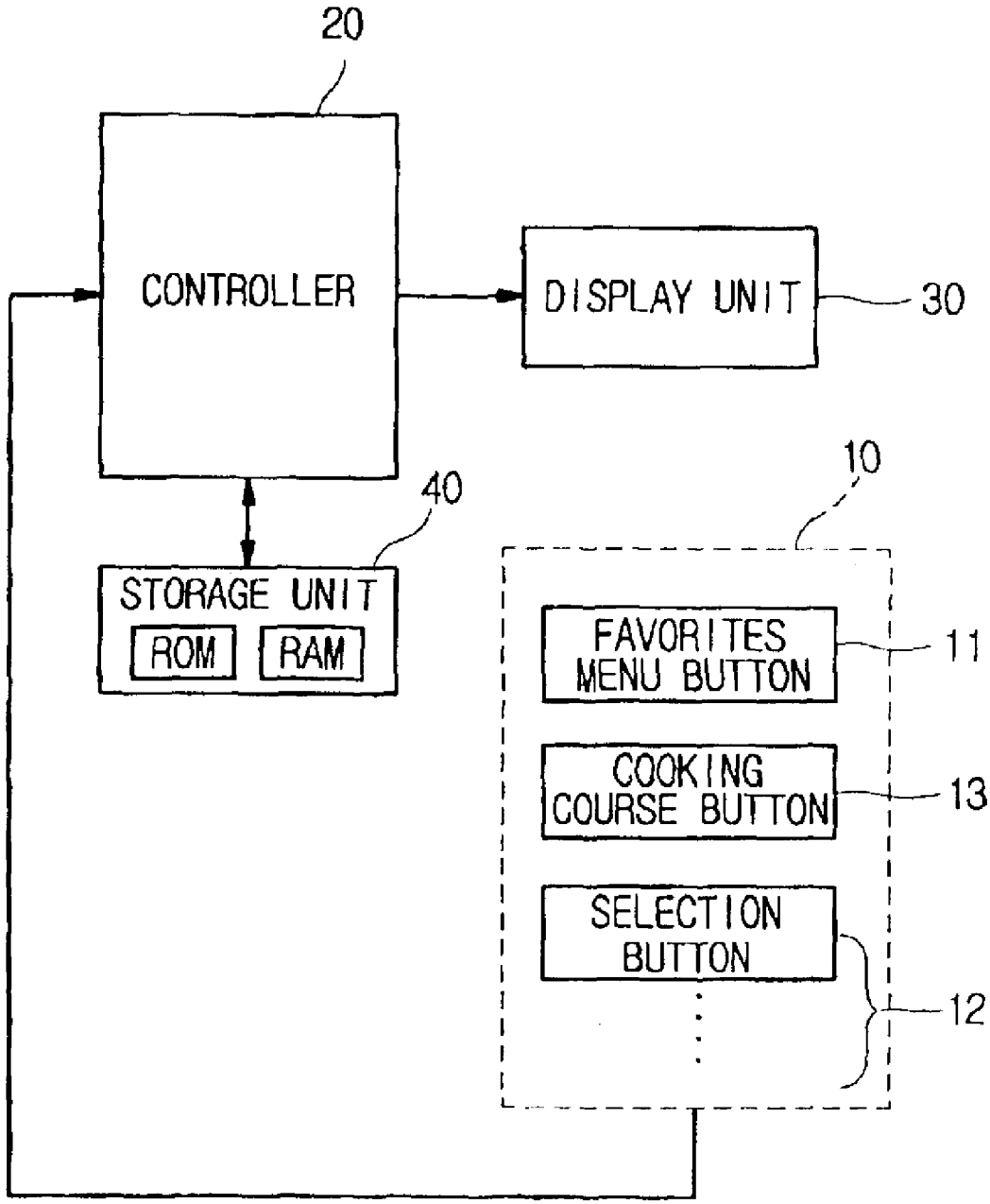
FIG. 2 is a block diagram illustrating an apparatus which controls a microwave oven in accordance with the present invention.

FIG. 2 shows a block diagram illustrating an apparatus which controls a microwave oven in accordance with the present invention.

As shown in FIG. 2, the microwave oven includes a microcomputer having a controller 20. The controller 20 controls a cooking operation of food and a registering operation, or a deleting operation of a variety of cooking courses which are previously stored in a favorites menu of the microwave oven. The favorite menu is set based upon a user's taste.

An output terminal of the controller 20 is electrically coupled to a display unit 30. The display unit 30 displays a screen containing the cooking courses so as to allow the user to select a desired cooking course through the screen to register or delete the same from the favorites menu. Furthermore, with the instant microwave oven, the user can register the desired cooking courses in the favorites menu or delete the desired cooking courses among the registered cooking courses from the favorites menu. The display unit 30 receives the selected cooking courses from the screen.

An input terminal of the controller 20 is electrically coupled to an input unit 10. The user can conveniently manipulate a screen displayed on the display unit 30 through the input unit 10.

Other input and output terminals of the controller 20 are electrically coupled to a storage unit 40. The storage unit 40 stores information relating to the cooking courses so that the user can search for and select a desired cooking course(s) from the cooking courses stored in the storage unit 40. The cooking courses to be registered can be positioned in the favorites menu stored in the storage unit 40 by a manipulation of the user.

A touch screen of the display unit 30 may be employed as the input unit 10. On the touch screen, buttons including selection buttons 12, a favorites menu button 11 and a cooking course button 13 are displayed. The input unit 10 may be provided by laminated touch screens so as to allow the user to select the favorites menu or the cooking course(s) by touching a corresponding surface(s) on the display unit 30.

The storage unit 40 is made up of a mask ROM (Random Only Memory) and a RAM (Random Access Memory). The mask ROM stores the cooking courses such as for a popcorn, a potato, a beverage, and a fish, and cooking information such as a cooking time period and a power level of a magnetron necessary to appropriately cooking foods corresponding to the cooking courses. The storage unit 40 also stores a favorites menu so as to allow the user to search for a desired cooking course in the favorites menu and cook food corresponding to the desired cooking course through an operation of the microwave oven.

The controller 20 controls the display unit 30. Under the control of the controller 20, the display unit 30 can display the cooking courses and the cooking information previously stored in the storage unit 40. The controller 20 controls a display operation where, for example, cooking courses are registered in the favorites menu or deleted from the favorites menu. The controller 20 registers selected cooking courses in a corresponding favorites menu or deletes the selected cooking courses from the corresponding favorites menu where the favorites menu button 11, the cooking course button 13, or a selection button 12 is selected.

Where the user presses the favorites menu button 11 on an initial screen of the input unit 10 shown in FIG. 2, the cooking courses registered in the favorites menu are displayed on the screen. The user can, for example, designate one of the cooking courses displayed on the screen and set cooking information including a cooking time period and a power level of a magnetron. Thereafter, the user can cook food corresponding to the designated cooking course having the user set cooking information.

To use a cooking course among cooking courses registered in the favorites menu, the user can extract desired cooking courses from the pre-stored cooking courses of the microwave oven and store the extracted cooking courses in the favorites menu. Thereafter, the user can recall and use any one of the cooking courses registered in the favorites menu.

Hereinafter, a registering operation of cooking courses in a favorites menu will be described.

FIGS. 3A to 3F illustrates a sequence of screens to register desired cooking courses in a favorites menu in accordance with an embodiment of the present invention. FIG. 4 shows a flow chart illustrating a method of registering the desired cooking courses in the favorites menu in accordance with the present invention.

Figure 3A:
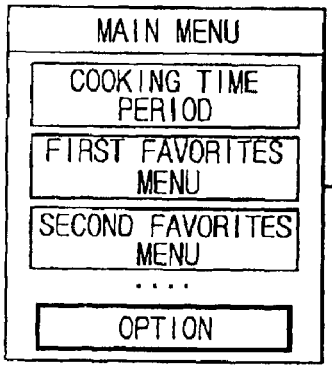
FIGS. 3A to 3F are views illustrating a sequence of screens to register desired cooking courses in a favorites menu in accordance with an embodiment of the present invention.
Figure 3B:
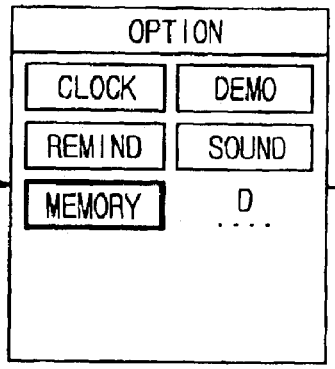
Figure 3C:
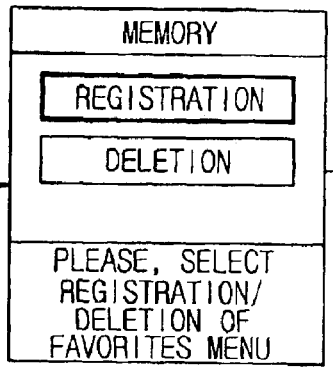
Figure 3D:
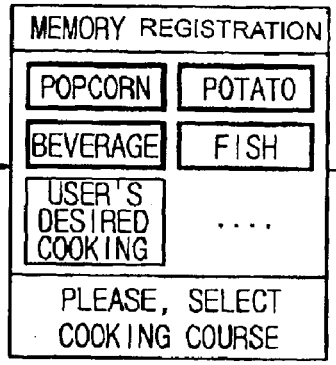
Figure 3E:
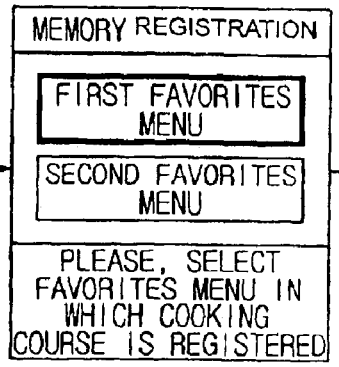
Figure 3F:
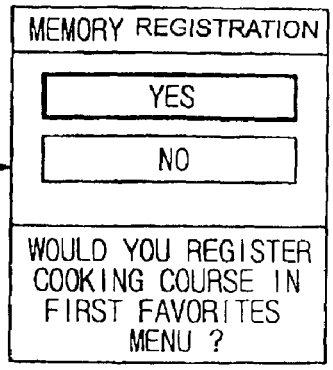
Figure 4:
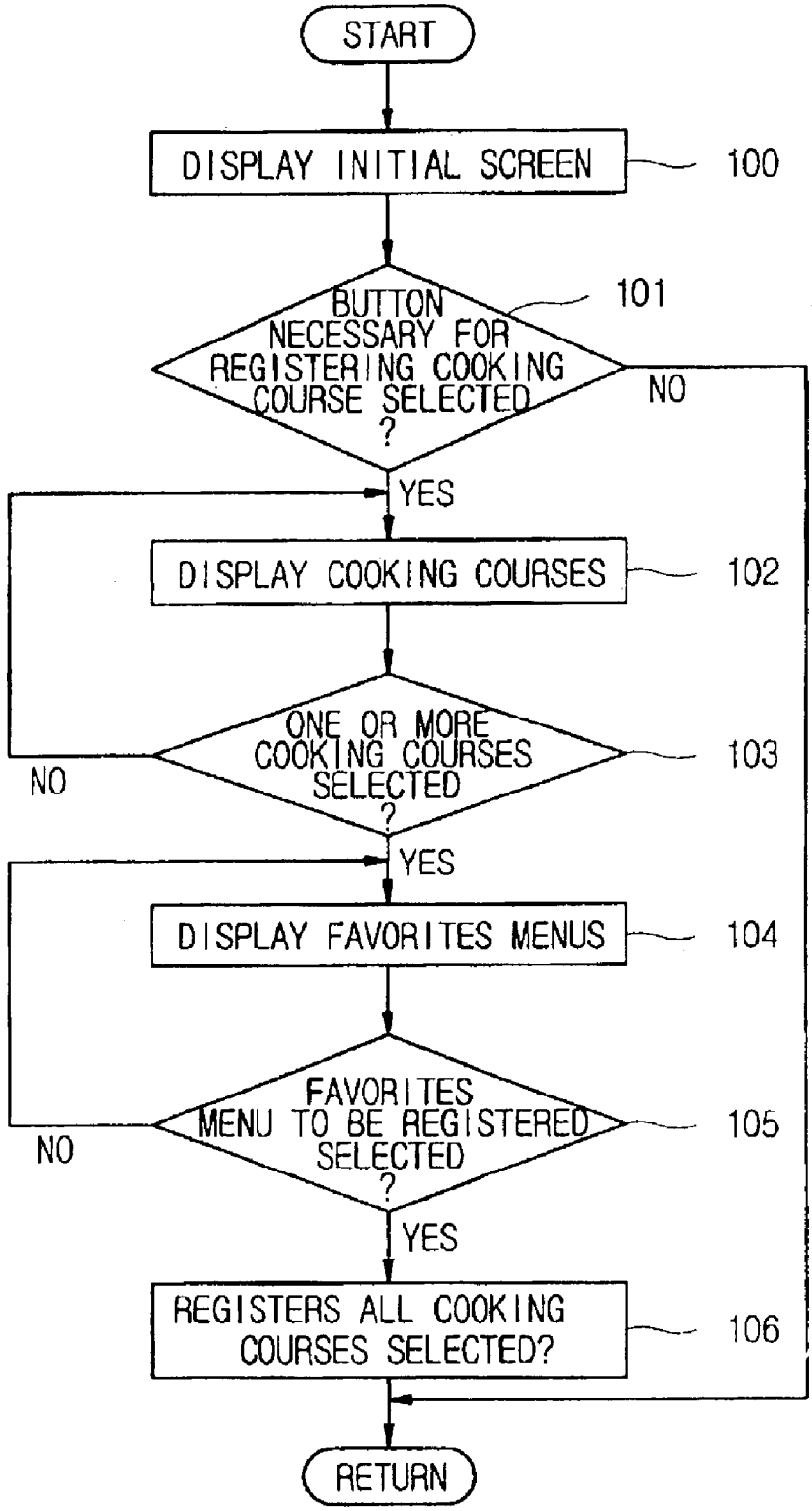
FIG. 4 is a flow chart illustrating a method of registering the desired cooking courses in the favorites menu in accordance with the present invention.

Referring to FIGS. 3A to 3F and FIG. 4, the display unit 30 under the control of the controller 20 displays an initial screen of FIG. 3A in an initial state, in operation 100. The controller 20 determines in operation 101 whether a user has selected a button to register desired cooking courses in a favorites menu. At this time, the controller 20 confirms whether an option button shown in FIG. 3A, a memory button shown in FIG. 3B or a registration button shown in FIG. 3C is selected. Here, a screen of FIG. 3B is displayed where the option button shown in FIG. 3A is selected. A screen of FIG. 3C is displayed where the memory button shown in FIG. 3B is selected. A screen of FIG. 3D is displayed where the registration button shown in FIG. 3C is selected.

The screens of FIGS. 3A, 3B and 3C will be described in detail. First, FIG. 3A illustrates the initial screen. The initial screen of FIG. 3A includes a plurality of favorites menu buttons and an option button. The favorites menu buttons are selected to classify and register the favorites menus according to, for example, a type of a cooking course. The option button is selected to set, for example, current time or sound in the microwave oven. The option button is also selected to register the cooking courses in the favorites menu or delete the cooking courses from the favorites menu. The user can directly set desired information through, for example, the favorites menu buttons and the option button.

The screen of FIG. 3B is displayed where the option button is selected in the screen of FIG. 3A. For example, the screen of FIG. 3B includes a clock button, a demo button, a sound button, a remind button and a memory button. The clock button is selected to set a current time in the microwave oven, and the sound button is selected to set a desired sound in the microwave oven. Where a user selects the remind button, the microwave oven informs the user of a reserved schedule.

The screen of FIG. 3C is displayed where the memory button is selected in the screen of FIG. 3B. The screen of FIG. 3C includes a registration button and a deletion button. The registration button is selected to register the cooking courses in the favorites menu, and the deletion button is selected to delete the registered cooking courses from the favorites menu. A lower portion of the screen displays a guidance message corresponding to the registration and deletion of the cooking courses, as, for example, shown in FIG. 3C.

Where the user has selected a button to register desired cooking courses in the favorites menu, as a result of the determination in the operation 101, the display unit 30 under the control of the controller 20 displays the screen of FIG. 3D in operation 102 so as to allow the user to select the desired cooking courses. Here, the screen of FIG. 3D includes various cooking courses including for popcorn, a potato, a beverage and a fish, and the desired cooking courses can be selected. The user can use corresponding pre-stored cooking information including cooking time information and magnetron power level information for the selected cooking courses. On the other hand, the user can directly set cooking information to a designated course, for example, to a user's desired cooking course shown in FIG. 3D.

Where desired cooking courses displayed in the screen of FIG. 3D are selected, the screen of FIG. 3E is displayed after the lapse of a certain time period. Alternatively, a completion button can be provided and selected so as to indicate that a selection of the desired cooking courses is completed, and accordingly, the screen of FIG. 3E can be displayed. Thereafter, the desired cooking courses can be simultaneously registered in one of the favorites menus.

While registering a plurality of cooking courses has been disclosed, it is understood that the present microwave oven can register a cooking course or delete a cooking course among a number of cooking courses registered in a favorites menu.

That is, after the cooking courses are displayed in the operation 102, the controller 20 determines whether the user has selected the one or more of the desired cooking courses in operation 103. Where the one or more of the desired cooking courses have been selected as a result of the determination in the operation 103, the screen of FIG. 3E is displayed in operation 104, so as to allow the user to select the one of the favorites menus in which the one or more of the desired cooking courses are registered. Here, the screen of FIG. 3E is displayed where the one or more of the desired cooking courses are selected in the screen of FIG. 3D. For example, first and second favorites menu buttons are provided in the screen shown in FIG. 3E. The first or second favorites menu button is selected to designate a favorites menu in which the selected one or more of the desired cooking courses are registered.

Referring to FIG. 4, after the favorites menus are displayed in the operation 104, a determination is made whether the user has selected a specific favorites menu in operation 105.

Where the specific favorites menu has been selected as a result of the determination in the operation 105, the controller 20 registers all of the cooking courses selected in the operation 103 in the specific favorites menu in operation 106. The one or more of the desired cooking courses are stored within the specific favorites menu included in the mask ROM of the storage unit 40. Even where power of the microwave oven is cut off, the one or more of the desired cooking courses corresponding to the favorites menu can remain stored and retrievable.

After the one or more of the desired cooking courses corresponding to the specific favorites menu are registered in the operation 106, the screen of FIG. 3F is displayed. Then, the initial screen is displayed or another routine is performed based on a preset control algorithm after the user confirms the memory registration. Where any one of the favorites menu buttons is selected in FIG. 3E, the user determines which favorites menu to register the selected cooking courses. To register the selected cooking courses in the favorites menu, the user uses the screen of FIG. 3F.

Hereinafter, a detailed description will be given of a method of registering a user's desired cooking course in a favorites menu. In this method, a user can set cooking information including a cooking time period and a power level of the microwave oven so as to have the microwave oven cook food using the user set cooking information.

Figure 6:
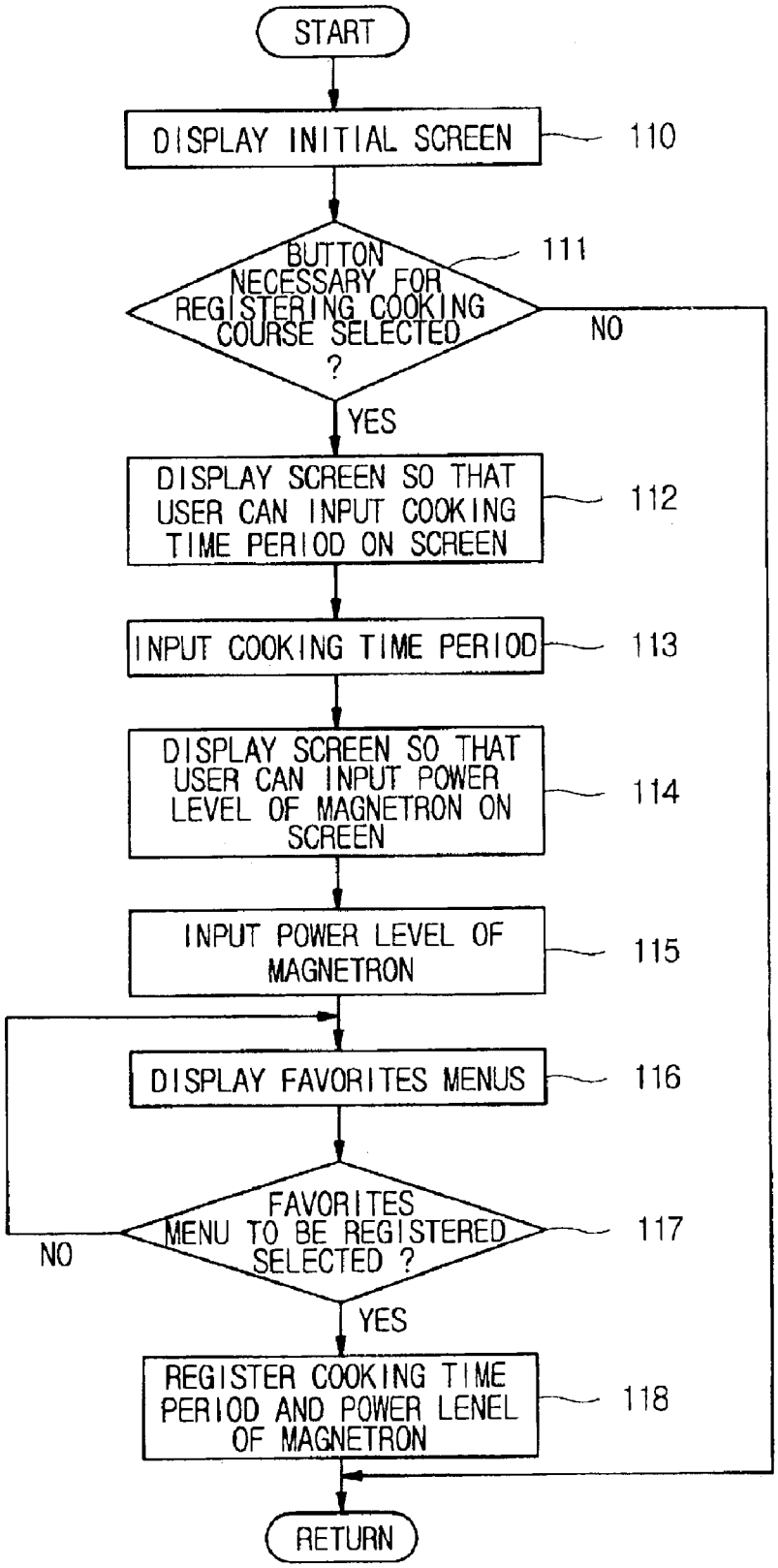
FIG. 6 is a flow chart illustrating another method of registering the user's desired cooking course in the favorites menu in accordance with the present invention.

FIGS. 5A to 5H illustrate a sequence of screens to register a user's desired cooking course in a favorites menu in accordance with another embodiment of the present invention. FIG. 6 shows a flow chart illustrating a method of registering the user's desired cooking course in the favorites menu.

Referring to FIG. 5A to FIG. 5H and FIG. 6, the display unit 30 under the control of the controller 20 displays a screen of FIG. 5A, as an initial screen, in an initial state in operation 110. The controller 20 determines in operation 111 whether a button necessary to register the user's desired cooking course in the favorites menu is selected. At this time, the controller 20 confirms whether an option button shown in FIG. 5A, a memory button shown in FIG. 5B, a registration button shown in FIG. 5C or a button for the user's desired cooking course shown in FIG. 5D is selected.

Where the button for "the user's desired cooking" course, as shown in FIG. 5D, is selected in the determination operation 111, the display unit 30 under the control of the controller 20 displays the screen of FIG. 5E in operation 112 so as to allow the user to input the cooking information including a cooking time period. The user inputs the desired cooking time period by pressing number buttons displayed on the screen of FIG. 5E in operation 113.

Where the desired cooking time period is input, the display unit 30 under the control of the controller 20 displays the screen of FIG. 5F in operation 114 so as to allow the user to input a power level of a magnetron of the microwave oven. The user inputs the power level of the magnetron by pressing number buttons displayed on the screen of FIG. 5F in operation 115.

Where the user inputs the power level of the magnetron, the display unit 30 under the control of the controller 20 displays the screen of FIG. 5G in operation 116 so as to allow the user to designate the favorites menu in which the user's desired cooking course with the user set cooking information is registered.

After the favorites menus are displayed in the operation 116, a determination is made whether the user has designated the favorites menu in operation 117.

Where the user has designated the favorites menu in the operation 117, the controller 20 registers the cooking time period (input in the operation 113) and the power level of the magnetron (input in the operation 115) in the user's desired cooking course of the designated favorites menu in operation 118.

A method of deleting cooking courses registered in a favorites menu will be described.

FIGS. 7A to 7F illustrate a sequence of screens to delete cooking courses registered in the favorites menu in accordance with yet another embodiment of the present invention. FIG. 8 shows a flow chart illustrating a method of deleting the cooking courses registered in the favorites menu in accordance with the present invention.

Figure 7A:
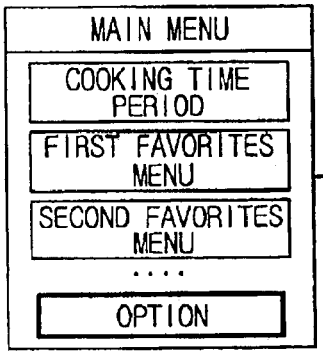
FIGS. 7A to 7F are views illustrating a sequence of screens to delete cooking courses among a number of cooking courses registered in a favorites menu in accordance with yet another embodiment of the present invention.
Figure 7B:
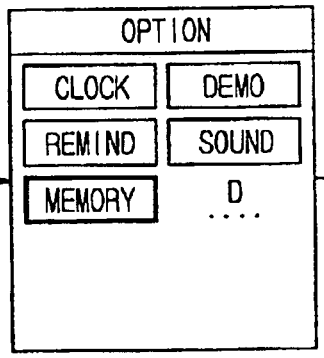
Figure 7C:
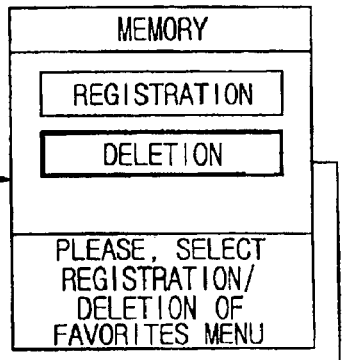
Figure 7D:
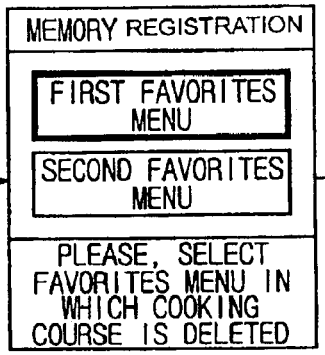
Figure 7E:
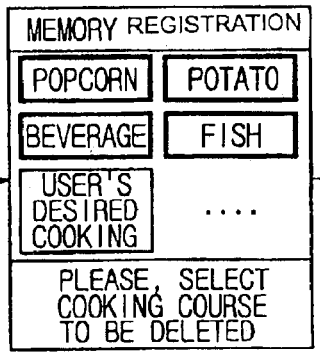
Figure 7F:
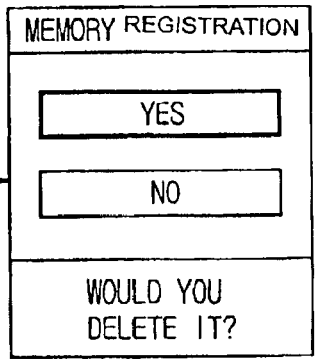
Figure 8:
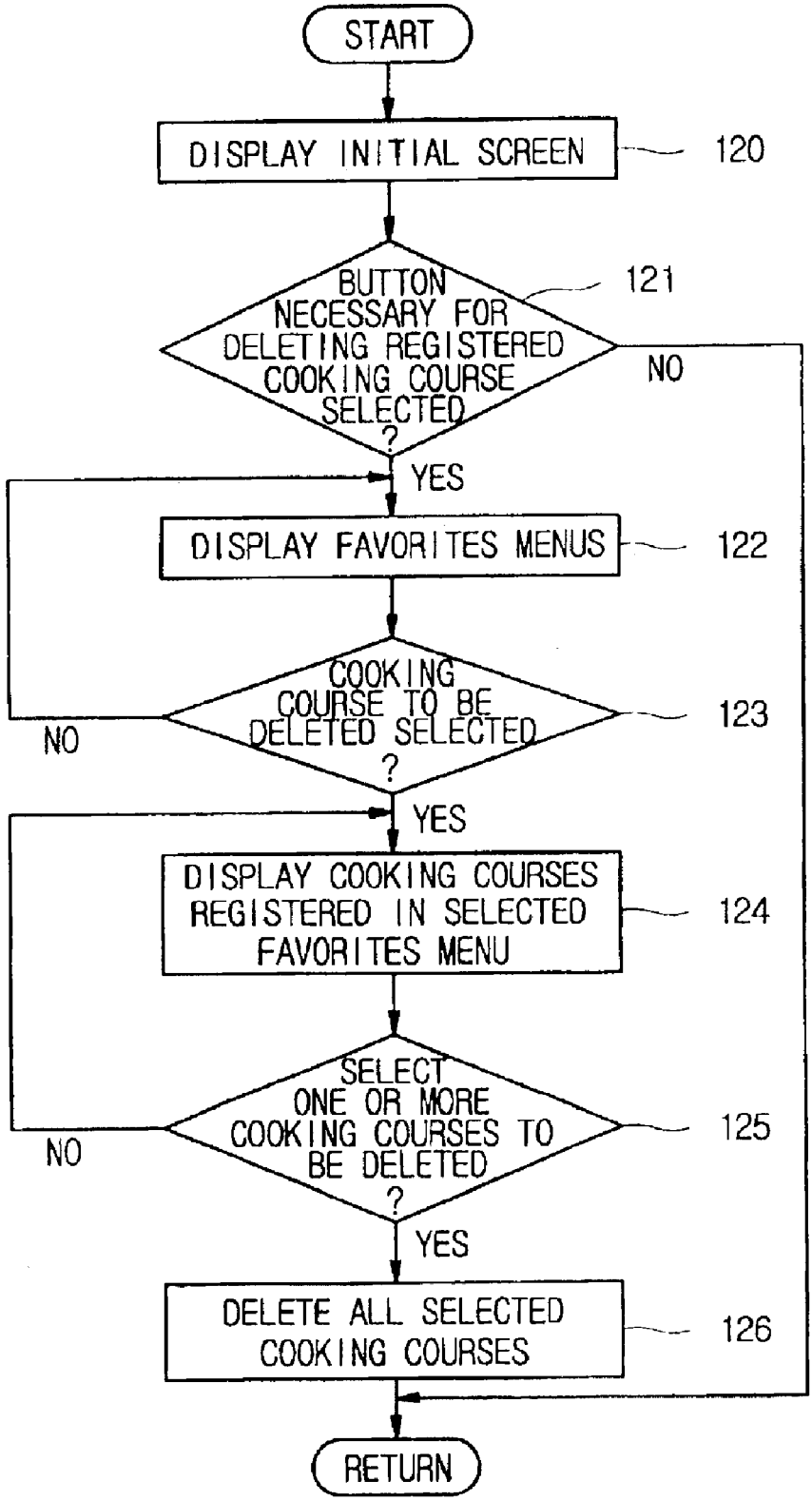
FIG. 8 is a flow chart illustrating a method of deleting the cooking courses among the number of cooking courses registered in the favorites menu in accordance with the present invention.

Referring to FIGS. 7A to 7F and FIG. 8, the display unit 30 under the control of the controller 20 displays a screen of FIG. 7A, as an initial screen, in an initial state in operation 120. The controller 20 determines in operation 121 whether a button necessary to delete the cooking courses registered in the favorites menu is selected. At this time, the controller 20 confirms whether an option button shown in FIG. 7A, a memory button shown in FIG. 7B or a deletion button shown in FIG. 7C is selected.

Where the deletion button has been selected to delete the cooking courses, the display unit 30 under the control of the controller 20 displays a screen of FIG. 7D in operation 122 so as to allow the user to select a favorites menu from which the cooking courses are to be deleted.

The controller 20 determines in operation 123 whether the user has selected a specific favorites menu from favorites menus displayed on the screen in the operation 122.

Where the user has selected a specific favorites menu, as a result of the determination operation 123, the display unit 30 under the control of the controller 20 displays a screen of FIG. 7E in operation 124 so as to allow the user to select one or more registered cooking courses to be deleted from the selected favorites menu.

After the display unit 30 displays the screen of FIG. 7E containing the registered cooking courses in the operation 124, the controller 20 determines whether the user has selected the one or more cooking courses to be deleted in operation 215. Where the user has selected the one or more cooking courses to be deleted, as a result of the determination operation 215, the controller 20 deletes the selected cooking courses in operation 216.

Hereinafter, a detailed description will be given of a method of carrying out a registered cooking course after registering or deleting one or more cooking courses selected by a user.

FIGS. 9A to 9E illustrate a sequence of screens to carry out a cooking course registered in a favorites menu in accordance with still another embodiment of the present invention. FIG. 10 shows a flow chart illustrating a method of carrying out the cooking course registered in the favorites menu in accordance with the present invention.

Figures 9A, 9B, 9C, 9D, 9E:
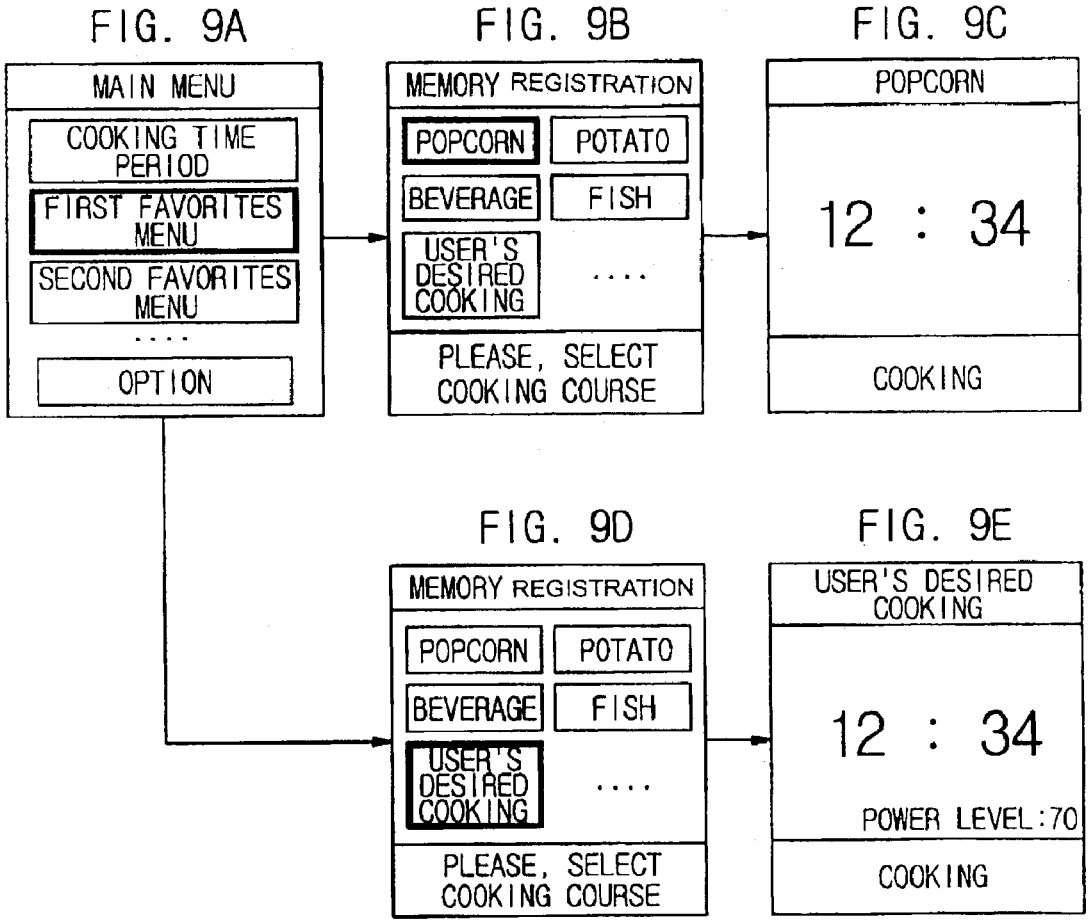
FIGS. 9A to 9E are views illustrating a sequence of screens to carry out a cooking course registered in a favorites menu in accordance with still another embodiment of the present invention.
Figure 10:
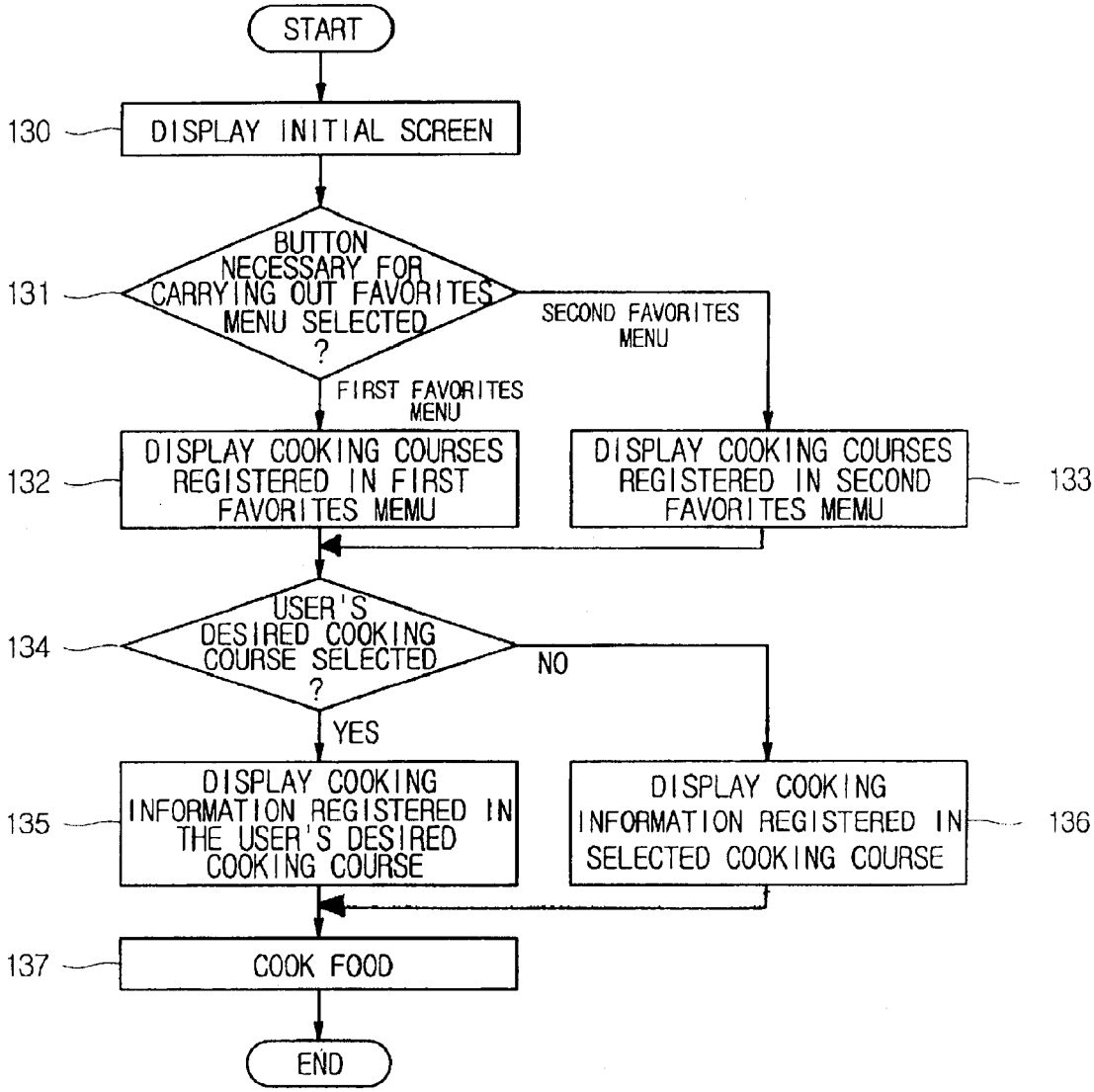
FIG. 10 is a flow chart illustrating a method of carrying out the cooking course registered in the favorites menu in accordance with the present invention.

Referring to FIGS. 9A to 9E and FIG. 10, the display unit 30 under the control of the controller 20 displays a screen of FIG. 9A as an initial screen in operation 130. Thereafter, a user can select a desired favorites menu.

The controller 20 determines in operation 131 whether a favorite button menu is selected by the user. In this case, the controller 20 determines whether the user has selected a first favorites menu or a second favorites menu in the screen of FIG. 9A.

Where the user has selected the first favorites menu in the operation 131, the display unit 30 under the control of the controller 20 displays a screen of FIG. 9B containing cooking courses registered in the first favorites menu in operation 132. Otherwise, where the user has selected the second favorites menu in the operation 131, the display unit 30 under the control of the controller 20 displays cooking courses registered in the second favorites menu in operation 133.

Where the cooking courses registered in the selected favorites menu are displayed, the user selects a desired cooking course to be carried out in operation 134. That is, where the user has selected the desired cooking course to be carried out, the controller 20 determines whether the selected cooking course is a user's desired cooking course in operation 134.

Where a cooking course different from the user's desired cooking course is selected in the operation 134, the display unit 30 under the control of the controller 20 displays a screen of FIG. 9C in operation 136 so as to allow the user to view information relating to the selected cooking course to be carried out. At this time, cooking information (e.g., a cooking time period) necessary to cook food of the selected cooking course is displayed on the screen of FIG. 9C.

On the other hand, where the user's desired cooking course is selected in the operation 134, the display unit 30 under the control of the controller 20 displays a screen of FIG. 9E so as to allow the user to view information relating to the user's desired cooking course in operation 135. At this time, cooking information (e.g., a cooking time period and the power level of the magnetron) necessary to cook food of the user's desired cooking course is displayed on the screen of FIG. 9E.

In operation 137, the controller 20 controls the microwave oven to cook the food based on the corresponding cooking information.

As described above, the present invention provides a microwave oven and a method of controlling the same, which can register or delete a plurality of cooking courses corresponding to a favorites menu at one time, thereby quickly carrying out and simplifying an operation of registering or deleting the one or more cooking courses corresponding to the favorites menu.

In the present invention, a plurality of cooking courses can be registered in a plurality of favorites menus based on a user's taste.

Furthermore, the user can arbitrarily set cooking information, including a cooking time period and a power level of a magnetron based on the user's taste, thereby allowing the microwave oven to cook food according to the user set cooking time period and the set power level of the magnetron.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven which controls an operation of registering cooking courses in a favorites menu of the microwave oven, comprising:

a heating unit to cook food;

a storage unit which stores the cooking courses and the favorites menu, wherein the cooking courses include at least one pre-stored cooking course having corresponding cooking information to automatically carry out a cooking operation corresponding to the pre-stored cooking course, and at least one user definable cooking course having arbitrarily set cooking information to automatically carry out a cooking operation corresponding to the user definable cooking course, and wherein the favorites menu includes at least one of the pre-stored cooking courses and at least one of the user definable cooking courses;

an input unit which receives the cooking courses to be registered in the favorites menu; and a controller which controls the storage unit so as to allow the cooking courses corresponding to the favorites menu input through the input unit to be registered and stored in the storage unit.

2. The microwave oven as set forth in claim 1, further comprising a display unit which displays a screen containing the cooking courses so as to allow selection of the cooking courses.

3. The microwave oven as set forth in claim 2, wherein:

the input unit includes:

cooking course buttons corresponding to the cooking courses; and favorites menu buttons which are used to selectively register the cooking courses in the favorites menu, the display unit includes a touch screen, and the cooking course buttons and the favorites menu buttons are provided on the touch screen.

4. The microwave oven as set forth in claim 1, wherein the input unit includes:

cooking course buttons corresponding to the cooking courses; and favorites menu buttons which are used to selectively register the cooking courses in the favorites menu.

5. The microwave oven as set forth in claim 1, wherein:

the heating unit includes a magnetron which generates microwaves to cook the food, the user definable cooking course cooking information includes a cooking time period and a power level of the magnetron thereto, and the controller controls the setting of the cooking time period and the power level.

6. A microwave oven which controls an operation of deleting cooking courses registered in a favorites menu of the microwave oven, comprising:

a heating unit to cook food;

a storage unit which stores the cooking courses and the favorites menu, wherein the cooking courses include at least one pre-stored cooking course having corresponding cooking information to automatically carry out a cooking operation corresponding to the pre-stored cooking course, and at least one user definable cooking course having arbitrarily set cooking information to automatically carry out a cooking operation corresponding to the user definable cooking course, and wherein the favorites menu includes at least one of the pre-stored cooking courses and at least one of the user definable cooking courses;

an input unit which receives the cooking courses to be deleted among the number of cooking courses registered in the favorites menu; and a controller which controls the storage unit so as to allow the cooking courses selected through the input unit to be deleted from the favorites menu of the storage unit.

7. The microwave oven as set forth in claim 6, further comprising a display unit which displays a screen containing the cooking courses so as to allow selection of the cooking courses.

8. The microwave oven as set forth in claim 7, wherein:

the input unit includes:

cooking course buttons corresponding to the cooking courses; and favorites menu buttons which are used to selectively register the number of cooking courses in the favorites menu, the display unit includes a touch screen, and the cooking course buttons and the favorites menu buttons are provided on the touch screen.

9. The microwave oven as set forth in claim 6, wherein the input unit includes:

cooking course buttons corresponding to the cooking courses; and favorites menu buttons which are used to selectively register the number of cooking courses in the favorites menu.

10. A method of controlling a microwave oven to register cooking courses in a favorites menu of the microwave oven, the method comprising:

displaying a screen to receive the cooking courses to be registered;

wherein the cooking courses include at least one pre-stored cooking course having corresponding cooking information to automatically carry out a cooking operation corresponding to the pre-stored cooking course, and at least one user definable cooking course having arbitrarily set cooking information to automatically carry out a cooking operation corresponding to the user definable cooking course, and wherein the favorites menu includes at least one of the pre-stored cooking courses and at least one of the user definable cooking courses;

receiving the cooking courses selected from the displayed screen; and controlling an operation of registering the selected cooking courses in the favorites menu.

11. The method as set forth in claim 10, further comprising:

displaying another screen to receive the favorites menu, in which the selected cooking courses are to be registered, in response to the microwave oven having more than one favorites menu to register the cooking courses;

receiving the favorites menu selected from the displayed screen thereof; and controlling an operation of storing-the selected cooking courses to the selected favorites menu.

12. A method of controlling a microwave oven to delete cooking courses among a number of cooking courses registered in a favorites menu of the microwave oven, the method comprising:

displaying a screen to receive the cooking courses to be deleted from the favorites menu;

wherein the cooking courses include at least one pre-stored cooking course having corresponding cooking information to automatically carry out a cooking operation corresponding to the pre-stored cooking course, and at least one user definable cooking course having arbitrarily set cooking information to automatically carry out a cooking operation corresponding to the user definable cooking course, and wherein the favorites menu includes at least one of the pre-stored cooking courses and at least one of the user definable cooking courses;

receiving the cooking courses selected from the displayed screen; and controlling an operation of deleting the selected cooking courses from the favorites menu.

13. A method of controlling a microwave oven to delete cooking courses among a number of cooking courses registered in one of favorites menus of the microwave oven, the method comprising:

displaying a first screen to receive a favorites menu among the favorites menus, from which the cooking courses are to be deleted;

wherein the cooking courses include at least one pre-stored cooking course having corresponding cooking information to automatically carry out a cooking operation corresponding to the pre-stored cooking course, and at least one user definable cooking course having arbitrarily set cooking information to automatically carry out a cooking operation corresponding to the user definable cooking course, and wherein the favorites menu includes at least one of the pre-stored cooking courses and at least one of the user definable cooking courses;

receiving the favorites menu selected from the displayed first screen;

displaying a second screen containing the cooking courses to be deleted among the number of cooking courses registered in the selected favorites menu;

receiving the cooking courses selected from the displayed second screen; and controlling an operation of deleting the selected cooking courses from the selected favorites menu.

14. A cooking apparatus having a favorites menu to register or delete cooking courses thereto, comprising:

a heating unit to cook food;

a storage unit which stores the cooking courses and the favorites menu, wherein the cooking courses include at least one pre-stored cooking course having corresponding cooking information to automatically carry out a cooking operation corresponding to the pre-stored cooking course, and at least one user definable cooking course having arbitrarily set cooking information to automatically carry out a cooking operation corresponding to the user definable cooking course, and wherein the favorites menu includes at least one of the pre-stored cooking courses and at least one of the user definable cooking courses;

a controller which controls an operation of the cooking apparatus; and a input unit which selectively receives the cooking courses to be registered in or deleted from the favorites menu according to a control signal of the controller, wherein the controller controls the storage unit so as to register or delete the cooking courses at one time.

15. The cooking apparatus as set forth in claim 14, wherein the input unit includes a touch screen which displays the cooking courses and allow selection of the cooking courses thereof.

16. The cooking apparatus as set forth in claim 14, wherein the heating unit includes a magnetron which generates microwaves to cook the food.

* * * * *

UNITED STATES PATENT AND TRADEMARK OFFICE

CERTIFICATE OF CORRECTION

PATENT NO. : 6,933,483 B2
DATED : August 23, 2005
INVENTOR(S) : Yun-Bong Chun

It is certified that error appears in the above-identified patent and that said Letters Patent is hereby corrected as shown below:

Column 11,
Line 38, replace “storing-the” with -- storing the --.

Signed and Sealed this

Sixteenth Day of May, 2006

JON W. DUDAS
*Director of the United States Patent and Trademark Office*